US008651237B2

(12) United States Patent
Pulliam

(10) Patent No.: US 8,651,237 B2
(45) Date of Patent: Feb. 18, 2014

(54) WORKER SUPPORT CAGE FOR FRONT END LOADER BUCKET

(76) Inventor: Richard D Pulliam, Oklahoma City, OK (US)

( * ) Notice: Subject to any disclaimer, the term of this patent is extended or adjusted under 35 U.S.C. 154(b) by 143 days.

(21) Appl. No.: 13/154,954

(22) Filed: Jun. 7, 2011

(65) Prior Publication Data

US 2011/0305552 A1 Dec. 15, 2011

Related U.S. Application Data

(60) Provisional application No. 61/353,103, filed on Jun. 9, 2010.

(51) Int. Cl.
*E04G 3/28* (2006.01)

(52) U.S. Cl.
USPC ..... 182/141

(58) Field of Classification Search
USPC ..... 182/222, 141, 127, 129, 2.1; 414/723, 414/724; 37/403, 407, 410, 444, 266, 268; 172/817, 684.5; 187/237
See application file for complete search history.

(56) References Cited

U.S. PATENT DOCUMENTS

| | | | | |
|---|---|---|---|---|
| 3,291,253 | A | 12/1966 | Wible | |
| 3,889,833 | A * | 6/1975 | Thomas | 414/607 |
| 3,893,540 | A | 7/1975 | Beucher | |
| 4,049,079 | A | 9/1977 | Stedman | |
| 4,314,622 | A | 2/1982 | Lindquist | |
| 4,687,073 | A | 8/1987 | Ashworth | |
| 4,813,164 | A * | 3/1989 | Morrell | 37/241 |
| 5,833,008 | A * | 11/1998 | Reed et al. | 171/141 |
| 6,578,295 | B1 | 6/2003 | McPherson | |
| 6,701,630 | B2 | 3/2004 | Humphrey | |
| 6,823,964 | B2 * | 11/2004 | Goode | 182/3 |
| 7,281,838 | B2 | 10/2007 | Melchiorre | |
| 7,963,053 | B1 * | 6/2011 | Courville | 37/405 |
| 8,257,008 | B2 * | 9/2012 | Ellingson | 414/608 |
| 2005/0111950 | A1 | 5/2005 | Shepperd et al. | |
| 2008/0149420 | A1 * | 6/2008 | Cheatham | 182/63.1 |

* cited by examiner

*Primary Examiner* — Katherine Mitchell
*Assistant Examiner* — Kristine Florio

(57) ABSTRACT

An apparatus is provided for lifting a worker into an elevated work position. The apparatus includes a worker-support cage configured for engagement with a bucket of a front-end loader.

3 Claims, 3 Drawing Sheets

WORKER SUPPORT CAGE FOR FRONT END LOADER BUCKET

RELATED APPLICATIONS

This application claims the benefit of U.S. Provisional Patent Application No. 61/353,103 filed on Jun. 9, 2010.

BACKGROUND OF THE INVENTION

The present invention generally relates to motorized construction and agricultural machines. More particularly, the invention relates to systems for supporting personnel in an elevated work position on such machines.

Front end loaders may employ hydraulically operated buckets to pick up and lift materials. In some cases, these buckets have been used to lift personnel into an elevated work position. A person may stand in the bucket and an operator of the front-end loader may raise the bucket to position the person within reach of a desired work location. Such a practice may be inherently risky because front-end loader buckets are not designed for personnel occupancy. A typical bucket may have no safety harnesses or guard rails. Consequently a worker in such a bucket may be at risk of falling or otherwise being injured.

As can be seen, there is a need for a system in which a worker may be safely lifted to an elevated work position in a front-end loader bucket. Furthermore, there is a need to provide such a worker with a safe working platform when he or she is in an elevated position.

SUMMARY OF THE INVENTION

In one aspect of the present invention, apparatus for lifting a worker into an elevated work position may comprise a worker support cage configured for engagement with a bucket of a front-end loader.

In another aspect of the present invention, accessory apparatus for a tractor may comprise: a cage assembly configured for engagement with a front-end loader bucket at a front end of the tractor and configured to meet Occupational Safety and Health Administration (OSHA) regulations for an elevated worker support when so engaged with the bucket, the cage assembly also being configured for engagement with a rear end attachment device of the tractor, and the cage having a horizontally hinged gate that can be opened when the cage assembly is engaged with the rear end attachment device of the tractor.

In still another aspect of the invention, a method for lifting a worker into an elevated work position may comprise the steps of: providing for placement of a worker support cage into a bucket of a front-end loader; and providing for securing the worker support cage to the bucket.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a worker-support cage that may be attached to a bucket of a front-end loader.

Figure 1:
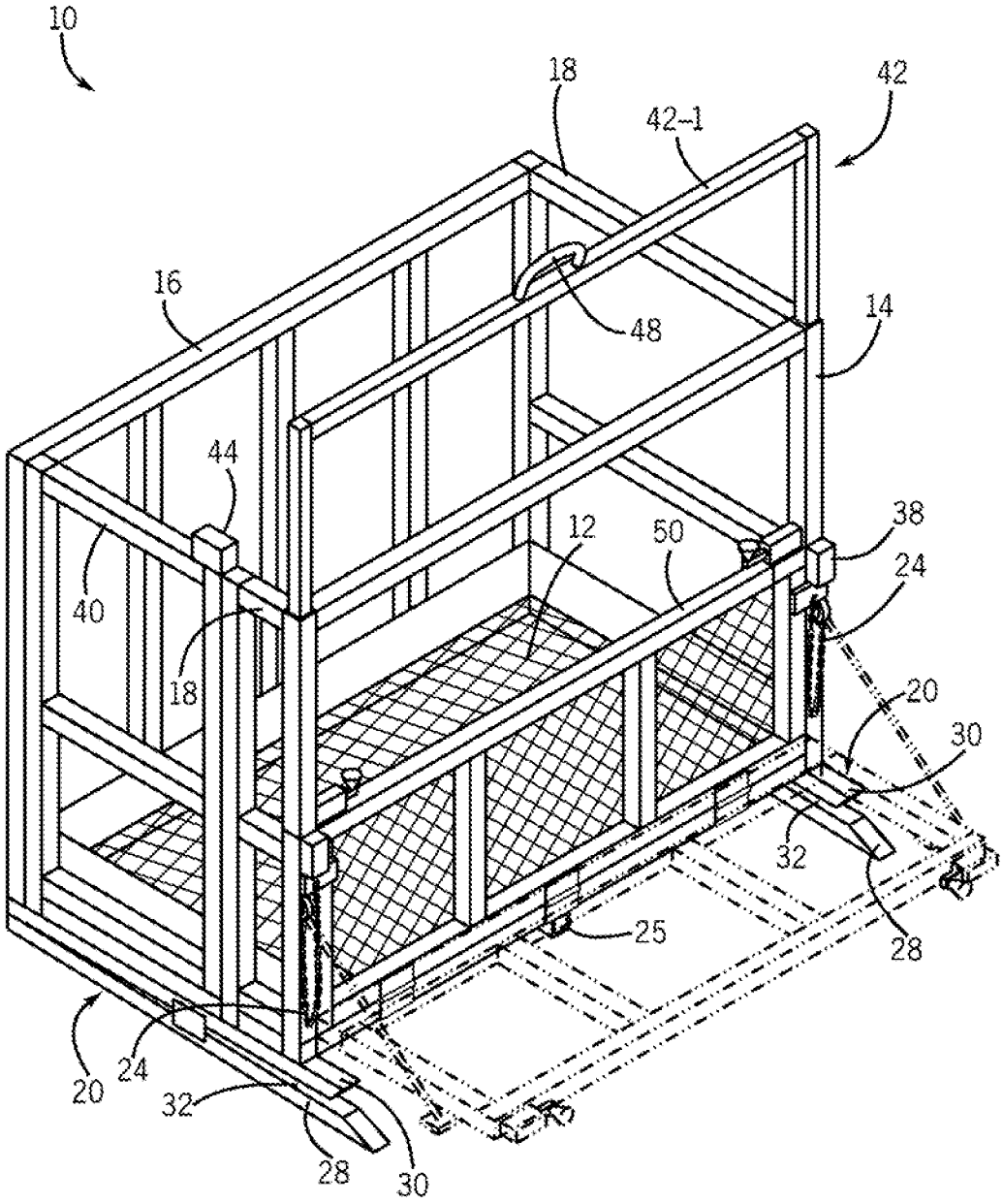
FIG. 1 is a perspective view of a worker-support cage in accordance with an embodiment of the invention.

Referring now to the FIG. 1, an exemplary embodiment of a worker-support cage 10 may be seen to comprise a work platform 12, an inboard side 14, an outboard side 16 and connecting sides 18. Base members 20 may be attached to the work platform 12. The base members 20 may comprise a bottom bar 28 and a top bar 30. The bars 28 and 30 may be positioned so that a tapered opening 32 may exist between the bars 28 and 30.

Figure 2:
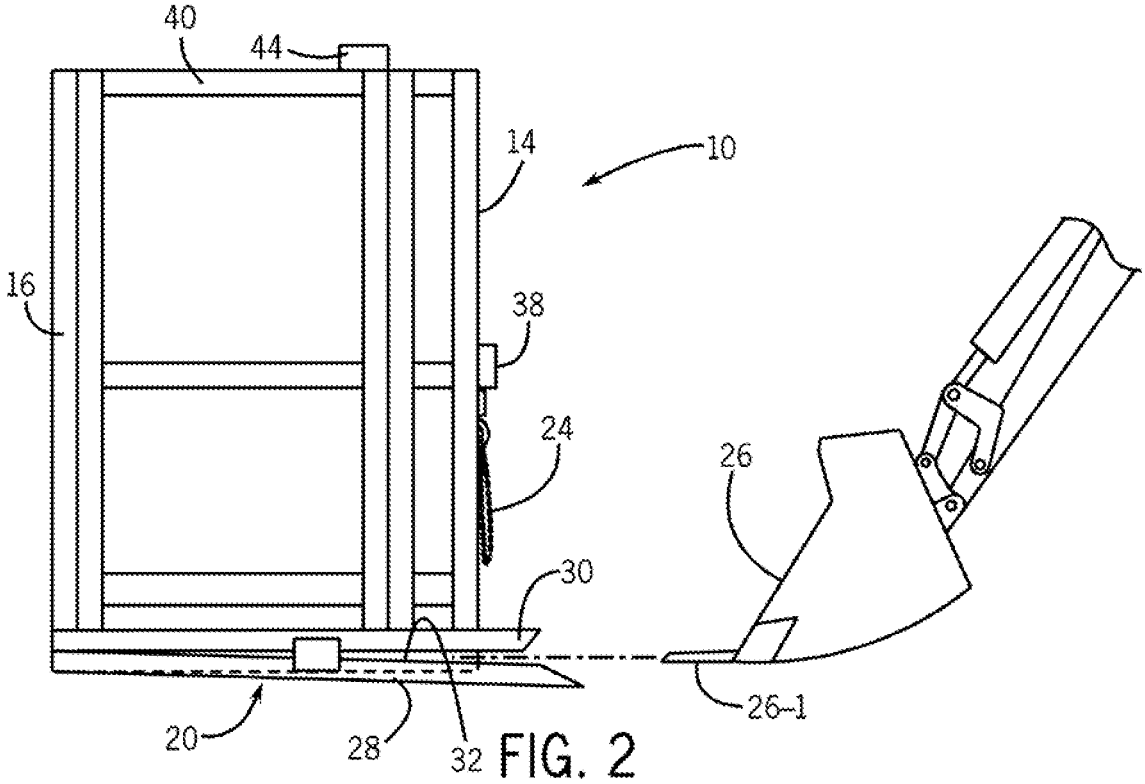
FIGS. 2, 3 and 4 are elevation views of the worker-support cage of FIG. 1 showing operational features of the cage.
Figure 3:
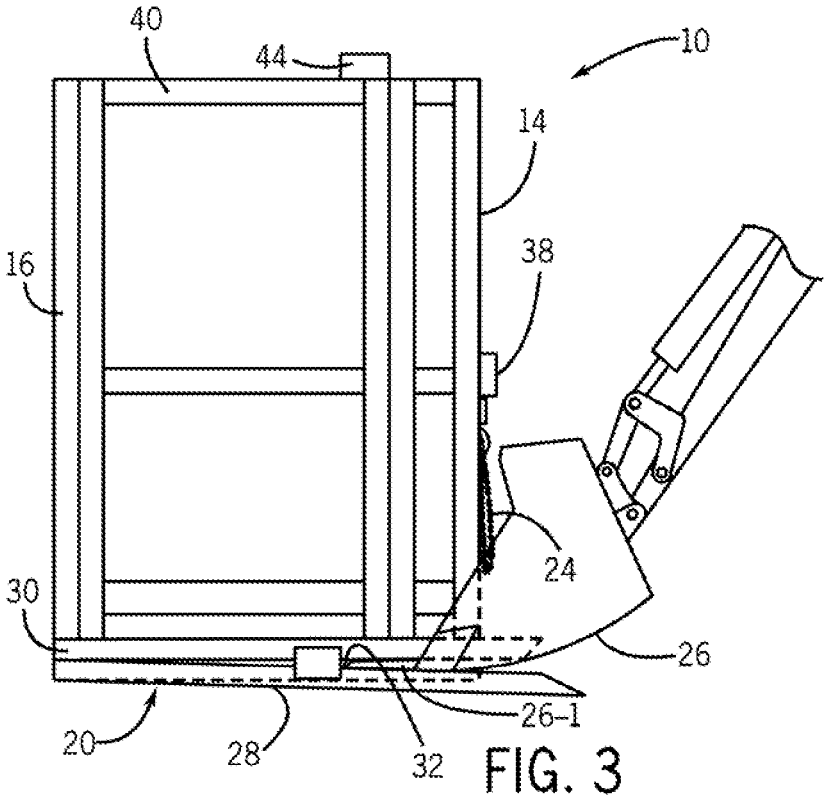
Figure 4:
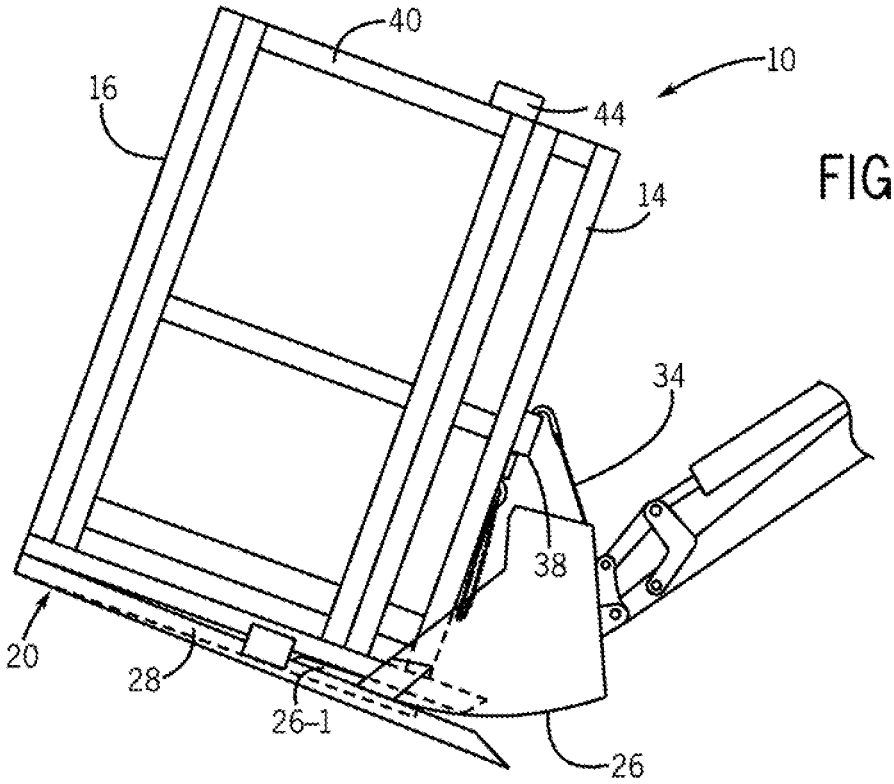

Referring now to FIGS. 2, 3 and 4, it may be seen that the worker support cage 10 may be expediently engaged with a front-end loader bucket 26. The tapered opening 32 may be configured so that a blade 26-1 of a front-end loader bucket 26 may be inserted into the tapered opening 32. As seen in FIG. 4, the bucket 26 may be tilted back and the cage 10 may be lifted a few feet above ground level. Securing straps 34 may then be attached to the inboard side 14 at a receiving pocket 38. The straps 34 may be passed around the bucket 26 and attached to an underside of the cage 10. The straps 34 may be conventional ratchet-tightening cargo straps. After being placed in position, the straps 34 may be tightened so that the cage 10 may be securely engaged with and held in position in the bucket 26.

After the cage 10 is securely engaged with the bucket 26, a person may enter the cage 10 through an access door 40. The access door 40 may be hinged to swing inwardly so that the door 40 may be operable even though portions of the bucket 26 may overlie the door 40 when the cage 10 is in position in the bucket 26. The door 40 may be provided with a latch 44. A safety-harness attachment bar 42 may be inserted into the inboard side 14. A top portion 42-1 of the bar 42 may be positioned about 60 inches above the work platform 12. Tops of the sides 14, 16 and 18 may be about 42 inches above the work platform 12. Thus the cage 10 may be configured to meet regulatory requirements of the Occupational Safety and Health Act (OSHA).

Figure 5:
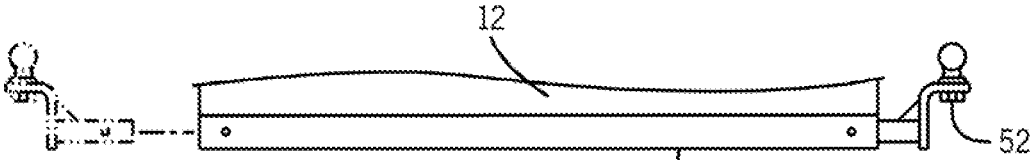
FIG. 5 is a detail view of a receiver bar of the cage of FIG. 1.

The cage 10 may be advantageously utilized as an accessory device for a farm tractor. In that regard, the cage 10 may be used a worker support device when engaged with a front-end bucket of the tractor as described above. Additionally, the cage 10 may be used for carrying materials and tools with the tractor. The cage 10 may be provided with a drop-down gate 50 in its inboard side 14. The cage 10 may also be provided with a receiver bar 25 that may be attached under the work platform 12 and may extend across its entire width. The receiver bar 25 may be open at each of its ends so that a trailer hitch 52 or other vehicle connecting device may be inserted into either end (See FIG. 5).

Figure 6:
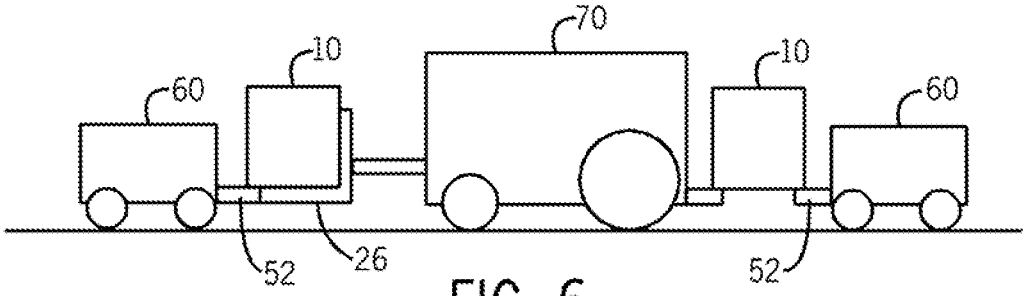
FIG. 6 is a block diagram of various connection arrangements of agricultural equipment and the cage of FIG. 1.

As shown in FIG. 6, the cage 10 may be connected to a trailer 60 even when the cage 10 is in the bucket 26 of a tractor 70. Alternatively, the cage 10 may be attached to a rear of the tractor 70 and used as a carrying device. Still further, a trailer 60 may be attached to the cage 10 at the rear of the tractor 70.

It should be understood, of course, that the foregoing relates to exemplary embodiments of the invention and that modifications may be made without departing from the spirit and scope of the invention as set forth in the following claims.

What is claimed is:

1. An apparatus for lifting a worker into an elevated work position comprising:

a worker support cage configured for engagement with a bucket of a front-end loader, wherein the support cage comprises at least one base member positioned at a bottom portion of the support cage, the base member including a bottom bar and a top bar positioned to form a tapered opening between the bottom bar and the top bar at a rear side of the support cage, the tapered opening configured to receive a blade of the bucket;

wherein the cage comprises:

an inboard side configured for orientation toward the bucket when engaged with the bucket;

an outboard side opposite the inboard side;

connecting sides interposed between the inboard and the outboard sides;

a personnel access door in at least one of the connecting sides, the access door being hinged to swing inwardly toward an interior of the cage; and a removable safety harness attachment bar configured for insertion into frame members of the inboard side; and wherein the inboard side of the cage is hinged along its bottom so that inboard side of the cage is hinged along its bottom so that inboard side can open outwardly away from an interior of the cage.

2. The apparatus of claim 1, wherein the cage comprises:

a work platform;

a trailer-hitch receiver attached to an underside of the work platform and extending across an entire length of the work platform, the trailer-hitch receiver being open at both of its ends so a trailer hitch can be inserted into either end of the trailer-hitch receiver.

3. An accessory apparatus for a tractor comprising:

a cage assembly configured for engagement with a front-end loader bucket at a front end of the tractor and configured to support an elevated worker when engaged with the bucket;

the cage assembly being configured for engagement with a rear end attachment device of the tractor, and comprising at least one base member positioned at a bottom portion of the cage assembly, the base member comprises a bottom bar and a top bar positioned to form a tapered opening between the bottom bar and the top bar at a rear side of the cage assembly, the tapered opening configured to allow insertion of a blade of the bucket into the opening, an inboard side configured for orientation toward the bucket when engaged with the bucket, an outboard side opposite the inboard side, connecting sides interposed between the inboard side and the outboard side; and a personnel access door in at least one of the connecting sides, the access door being hinged to swing inwardly toward an interior of the cage, the cage assembly having a horizontally hinged gate configured to open when the cage assembly is engaged with the rear end attachment device of the tractor.

* * * * *